US007448945B2

(12) United States Patent
Bessent

(10) Patent No.: US 7,448,945 B2
(45) Date of Patent: Nov. 11, 2008

(54) CLEAN WORK BOOTH

(76) Inventor: Kyle B. Bessent, 2344 Jones Rd., Jacksonville, FL (US) 32220

( * ) Notice: Subject to any disclaimer, the term of this patent is extended or adjusted under 35 U.S.C. 154(b) by 455 days.

(21) Appl. No.: 11/201,552

(22) Filed: Aug. 11, 2005

(65) Prior Publication Data

US 2007/0033882 A1 Feb. 15, 2007

(51) Int. Cl.
*B08B 15/00* (2006.01)
*B08B 15/02* (2006.01)

(52) U.S. Cl. ..... 454/63; 454/49; 454/187; 52/63; 55/356; 55/385.2; 135/142

(58) Field of Classification Search ..... 454/49, 454/63, 187; 55/356, 385.2; 52/63; 134/99.1; 135/142
See application file for complete search history.

(56) References Cited

U.S. PATENT DOCUMENTS 4,682,448 A * 7/1987 Healey ..... 52/63
4,750,587 A * 6/1988 McAllister et al. ..... 182/161
4,995,914 A * 2/1991 Teter ..... 134/21
5,080,701 A * 1/1992 Howard et al. ..... 55/356
RE33,810 E * 2/1992 Strieter ..... 134/99.1
5,558,112 A * 9/1996 Strieter ..... 134/103.2
6,383,242 B1 * 5/2002 Rogers et al. ..... 55/385.2

FOREIGN PATENT DOCUMENTS

EP 459492 A1 * 12/1991

* cited by examiner

*Primary Examiner*—Steven B McAllister
*Assistant Examiner*—Patrick F. O'Reilly, III
(74) *Attorney, Agent, or Firm*—Arthur G. Yeager

(57) ABSTRACT

A mobile clean room has a substantially rectangular frame having an upper and lower portion and is formed of a plurality of metal tube members and transparent plastic wall panels affixed to the frame to form an end wall and front and rear walls. A floor plate is affixed to the lower portion of the frame. A plurality of locking swivel wheels is affixed to the lower portion of the frame. A ladder is mounted between the floor plate and the upper portion of the frame. A dust guard assembly is attached to the top of the frame and is movably mounted. A door is pivotally mounted to the frame.

15 Claims, 7 Drawing Sheets

CLEAN WORK BOOTH

CROSS REFERENCE TO RELATED APPLICATION

Not Applicable.

REFERENCE TO A MICROFICHE APPENDIX

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to clean rooms or booths and particularly to mobile clean rooms that interface with an area upon which work and cleaning will be accomplished.

2. Relevant Art

Clean rooms and associated technology are well known in the art. What is desired is a clean room with a movable portion that can provide a substantially airtight interface with, for example, a ceiling, allowing ceiling tiles to be removed without exposing the surrounding area to dirt and debris that exists in the area above the ceiling where maintenance work is to be performed. None of the clean rooms known to the prior art are satisfactory.

BRIEF SUMMARY OF THE INVENTION

In one aspect of the present invention there is provided a mobile clean room comprising a vertically disposed room frame having an upper and lower portion, a plurality of wall panels affixed between the upper and lower portion of the frame to define an interior space and to form an end wall and front and rear walls, a door hingedly affixed to the frame to form another end wall, a floor panel affixed to the lower portion of the frame, a plurality of wheels affixed to the lower portion of the frame for movably carrying the frame, a dust collection assembly movably attached to the upper portion of the frame and selectively positionable against a ceiling. The wall panels are formed of transparent plastic material and the floor panel is formed of an aluminum plate. The dust collection assembly includes a horizontally disposed curtain frame carrying a ceiling seal and defining an access space and a subtending curtain affixed to the curtain frame, the curtain located interiorly of the room frame, the curtain frame being adapted to fit closely adjacent a ceiling surface with the ceiling seal being compressed.

A pair of spaced hollow guides are attached to the lower portion of the room carrying within a pair of spaced posts subtending from the curtain frame for guided vertical movement of the curtain frame. Locking fasteners are attached between a respective guide and post for selectively securing the post in a desired position.

A ladder is mounted between the upper portion of the room frame and the floor panel. Electrical receptacles are attached to one wall or frame for providing electrical power into the room from an external source of electric power. The floor panel includes an exhaust port therethrough for removing air from the interior space. A vacuum apparatus in the interior space has an outlet removably affixed to the exhaust port.

In another aspect of the present invention there is provided a mobile clean room comprising a vertically disposed room frame having an upper and lower portion, a plurality of wall panels affixed between the upper and lower portions of the frame to define an interior space and to form an end wall and front and rear walls, a door mounted to the frame to form another end wall, a floor panel affixed to the lower portion of the frame, a plurality of wheels affixed to the lower portion of the frame for movably carrying the frame, a ladder disposed in the interior space mounted between the upper portion of the room frame and the floor panel, a dust collection assembly movably attached to the upper portion of said frame. The wall panels are formed of transparent plastic material and the floor panel is formed of an aluminum plate. The dust collection assembly includes a horizontally disposed curtain frame defining an access space and a subtending curtain affixed to the curtain frame, the curtain located interiorly of the room frame, the curtain frame being adapted to fit closely adjacent a ceiling surface. A deck is affixed to the upper portion of the room frame mounted between the upper portion of the room frame and the floor panel. Electrical receptacles including a female receptacle attached to the deck are attached to one wall or frame for providing electrical power into the room from an external source of electric power. The floor panel includes an exhaust port therethrough for removing air from the interior space.

In a further aspect of the present invention there is provided a mobile clean room comprising a substantially rectangular frame having an upper and lower portion formed of a plurality of metal tube members, a plurality of transparent plastic wall panels affixed to the frame to form an end wall and front and rear walls, a floor plate affixed to the lower portion of the frame, a plurality of locking swivel wheels affixed to the lower portion of the frame, a ladder mounted between the floor plate and the upper portion of the frame, a dust guard assembly and attachment means for movably mounting the assembly to the upper portion of the frame, a door pivotally mounted to the frame.

The means for slideably mounting the ladder includes a bracket attached to the upper portion of the room and another bracket attached to the ladder. The brackets form an upwardly facing groove and a downwardly facing groove located with one groove supporting another bracket.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
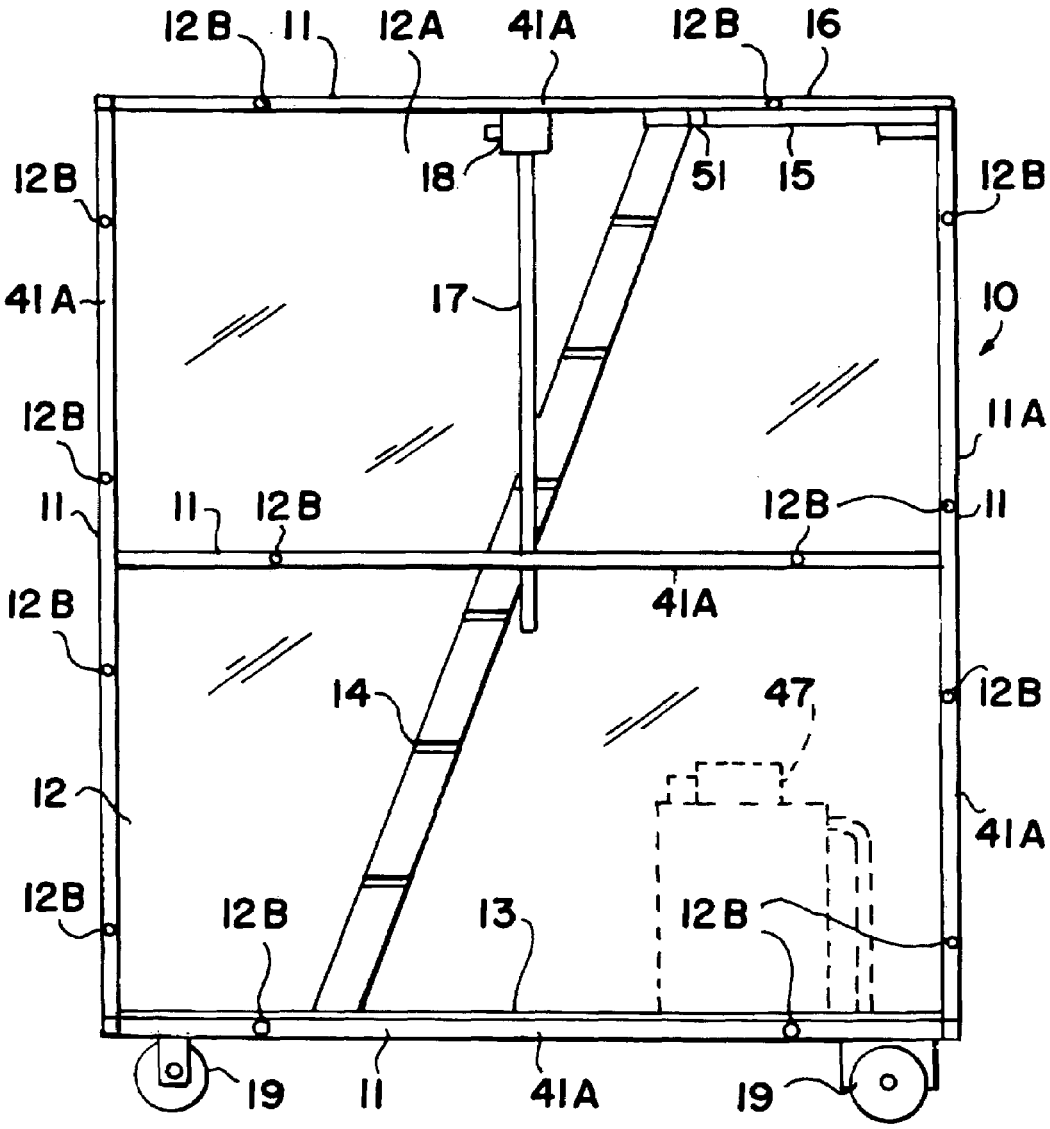
FIG. 1 is a front view of the clean work booth in accord with the present invention shown without the dust guard assembly and removable vinyl cover.
Figure 6:
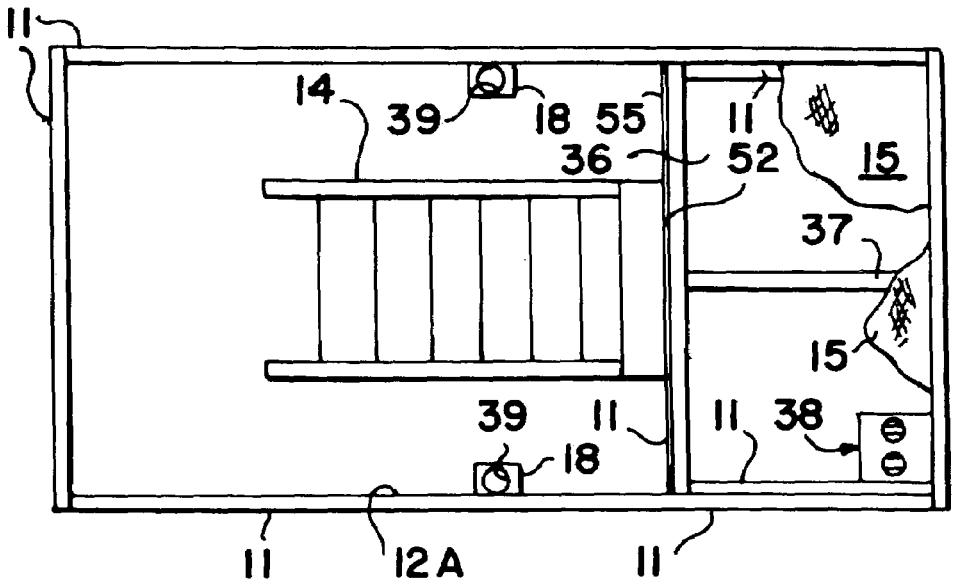
FIG. 6 is a top view of the booth of FIG. 1.
Figure 7:
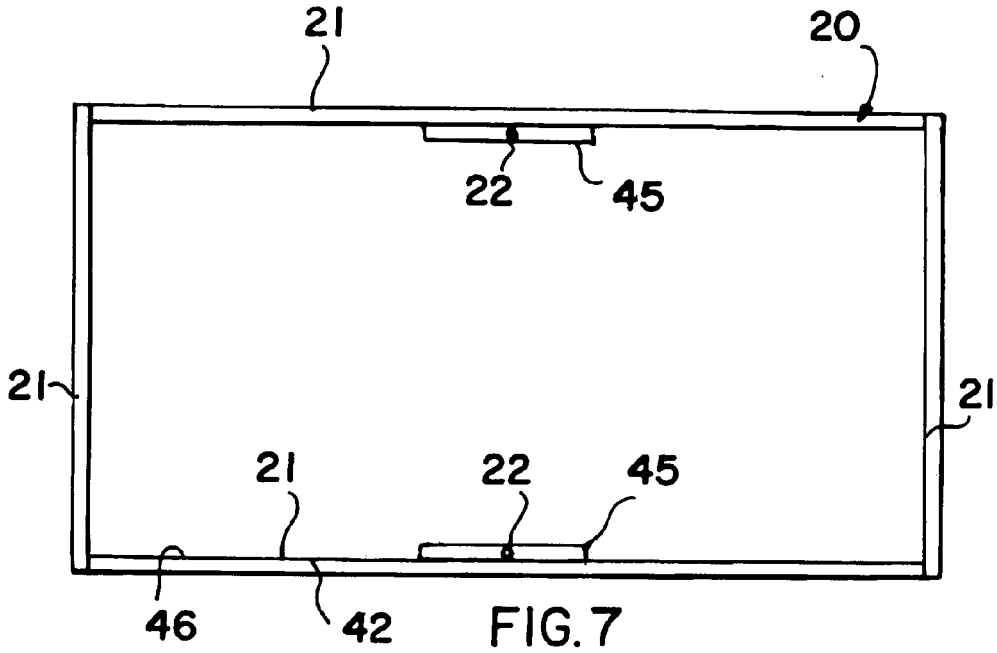
FIG. 7 is a top view of the dust guard assembly component used with the booth of FIG. 1.
Figure 8:
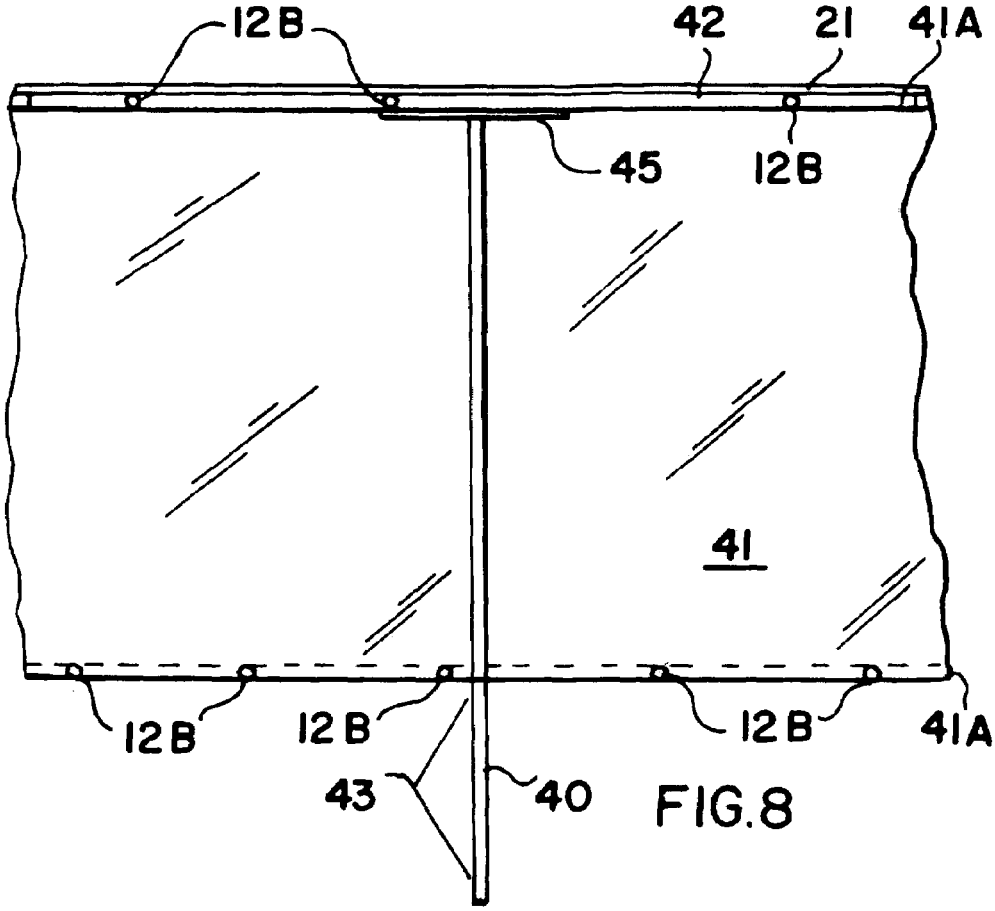
FIG. 8 is a side view of the dust guard assembly of FIG. 2.

With reference now to the drawings, a front view of the booth or room in accord with the present invention is shown at numeral 10 in FIG. 1. A plurality of tubular metal frame members 11 are connected conventionally to form a substantially rectangular frame 11A and onto which a plurality of transparent plastic wall panels 12 formed of heavy (30 mil) vinyl are mounted to define an interior space 12A (FIG.6). A floor 13 (FIG. 5) is a diamond pattern aluminum member to reduce the weight of the room 10. A ladder 14 is mounted inside the booth 10 between floor 13 and a diamond pattern aluminum deck 15 by appropriate brackets or the like. A perimeter foam rubber rim 16 supports the dust guard assembly 20 (FIGS. 7, 8). The booth frame 11 includes a pair of hollow metal guides 17 attached via fasteners 22 (FIG. 7) into which a pair of assembly posts 40 fit and are secured at a desired height via spring-loaded locking washers 18. Booth 10 is supported by four locking swivel wheels 19 for rolling the booth 10 to a desired location.

Figure 2:
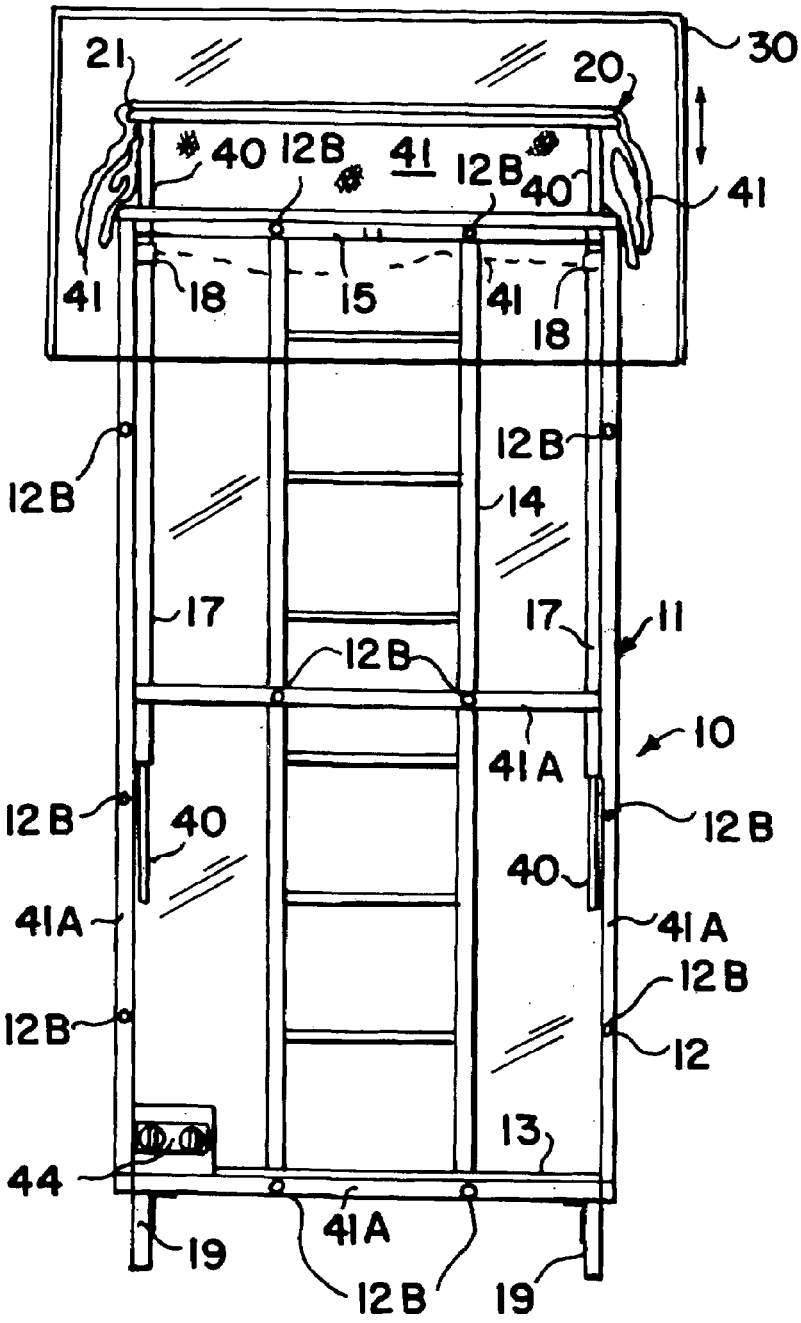
FIG. 2 is a right side view of the booth of FIG. 1.

FIG. 2 is a right side view of the booth 10 and shows the dust guard assembly 20 which includes foam rubber seals 21 that rest against a ceiling around ceiling tiles that are to be removed to provide a substantially airtight interface with a ceiling to keep debris inside the room 10.

Figure 3:
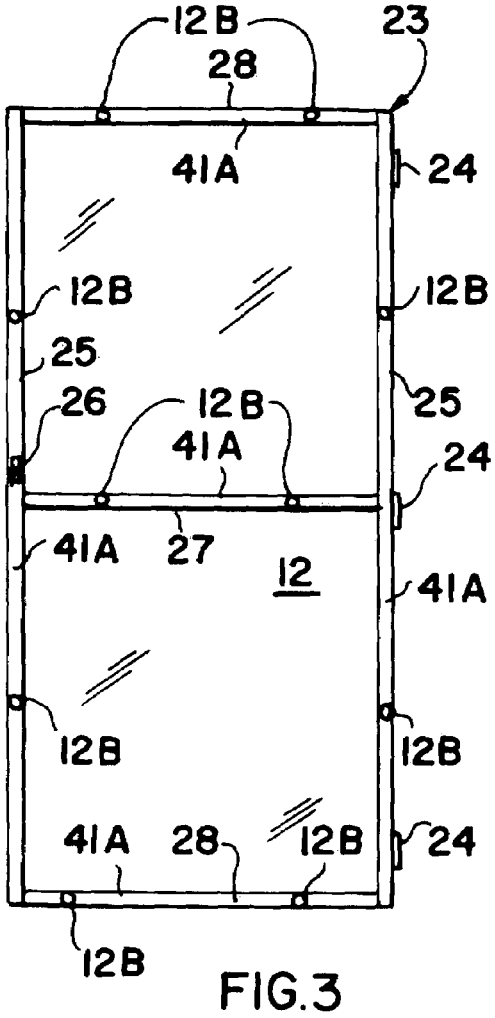
FIG. 3 is a view of the door used in the booth of FIG. 1.
Figure 4:
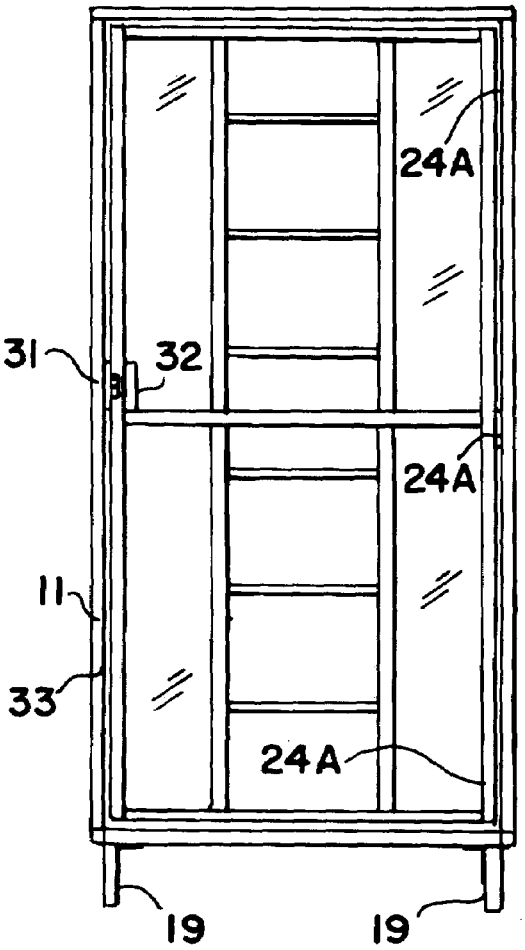
FIG. 4 is a left side view of the booth of FIG. 1.

FIGS. 3 and 4 illustrate the door 23 used in the left side of the booth 10. Plastic panel 12 is affixed to door frame members and is the same as before.

Three hinge joints 24, 24A attach door 23 to frame 11. Frame members 25, 27, 28 are metal tubes similar to members 11. Door handle lock assembly 26, 31, 32 is conventional as understood in the art. A fitted transparent vinyl cover or hood 30 is used to cover assembly 20 when the booth 10 is moved or stored (FIG. 2).

Rubber seal 33 is mounted on the frame 11 and not on the door 23.

Figure 5:
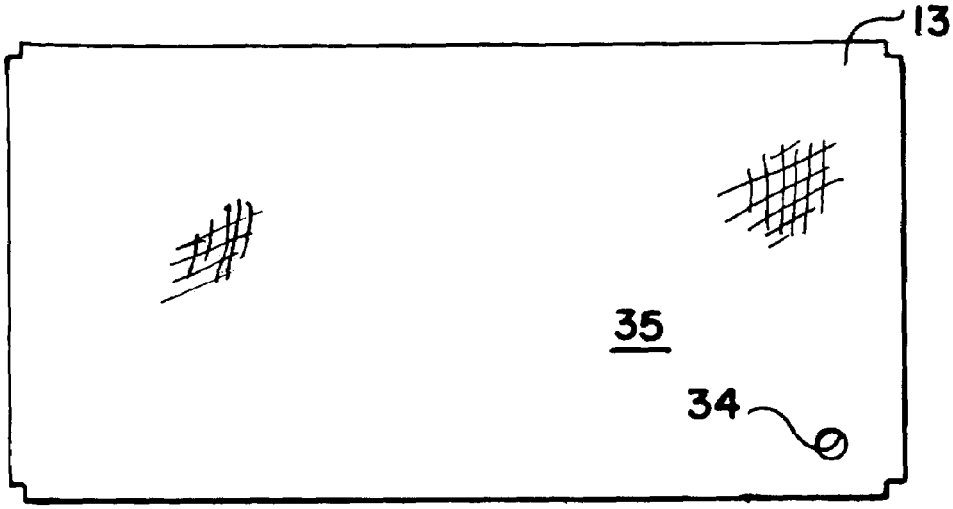
FIG. 5 is a top plan view of the floor used in the booth of FIG. 1 with the upper deck shown only pictorially.

FIG. 5 illustrates a diamond pattern aluminum plate 35 with exhaust hole 34 used as floor 13.

FIG. 6 illustrates the interior space 39 of locking washers 18 used to control the height of assembly 20. Electrical plugs 38 are interior sources of power and receive power externally from male plugs 44 which are wired to female plugs 38 through a frame member (FIG. 2). Deck 15 is supported on frame members 11 and beam 37 and includes a diamond pattern aluminum plate 36.

FIGS. 7 and 8 illustrate the dust guard assembly 20 that includes a rectangular curtain frame 42 defining space 46 covered by foam rubber 21. Guide posts 40 extend downwardly from brackets 45 attached by threaded fastener 22. Guide posts 40 fit in tubes 17 and are longer than guide tubes 17 by the length designated by numeral 43 which provides adequate vertical height adjustment.

FIG. 2 shows, in pictorial fashion, the folding and draping of the curtain 41 partially inside and partially outside frame 11A when dust collection assembly 20 is lowered.

Figure 10:
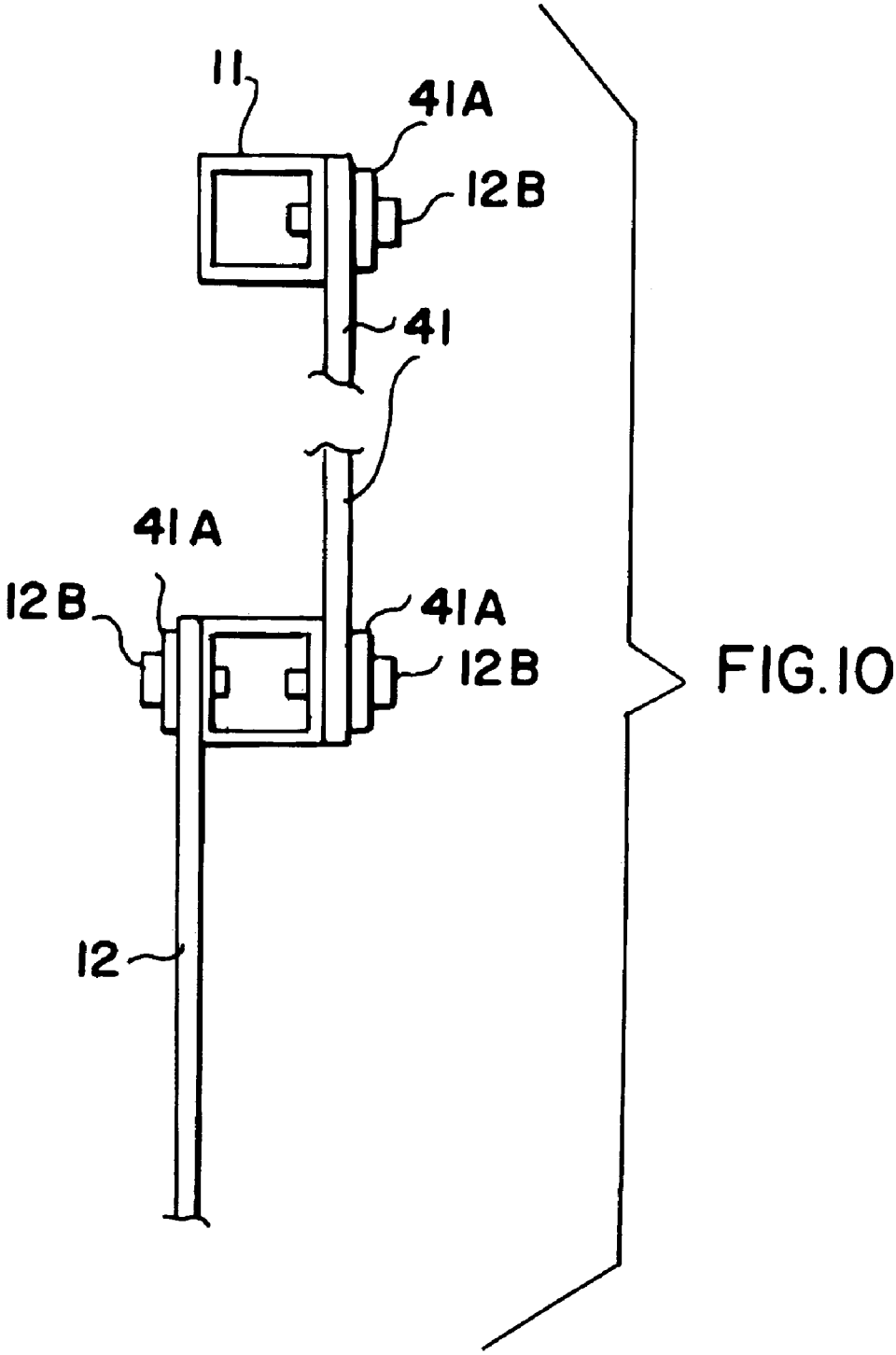
FIG. 10 is a partial cross-section of the connection means used for the wall panels and dust collection assembly in accord with the present invention.

FIG. 10 is a partial cross-section view of further construction details. A vinyl panel 12 is shown attached to a frame member 11 at the top of the lower portion of the room. Spaced rivets 12B connect through frame member 11 and a metal strip 41A and pass through the lower edge of curtain 41 that is also attached to the inside edge of the perimeter of curtain frame 42 component of dust collection assembly 20. Inside the selectively adjustable assembly 20 is an access space to allow a user to access a ceiling. The foam ceiling sealing means 21 is compressed when fitting against a ceiling around an opening therein (FIG. 8).

The lower portion of room 10 shown in FIG. 1 is approximately 5'10" high. The maximum vertical height of curtain 41 (FIG. 8) is approximately 4'7". This sizing allows for the movement of the room 10 in virtually all standard elevators but allows for access to virtually all ceilings at heights even exceeding 10'.

Figure 9:
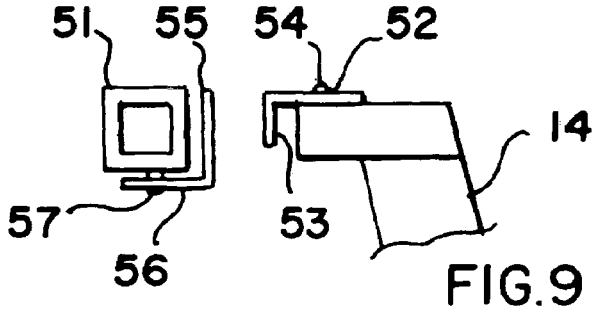
FIG. 9 is a detail of the connection apparatus used for the slideable mounting of the ladder in accord with the present invention.

FIG. 9 illustrates the preferred method of mounting ladder 14 to frame member 51 of upper deck 15. An angle bracket 52 is attached to ladder 14 via bolts 54 or other appropriate means. A downwardly facing groove or recess 53 fits in upwardly facing recess or groove 55 defined by an upstanding portion of an angle bracket 56 bolted to frame member 51 via bolts 57. Ladder 14 is thus slideably mounted to be moved from side-to-side inside room 10 as desired.

Optional vacuum cleaner 47 includes a HEPA filter and exhausts through exhaust port 34 and is operated to continuously clean the air in the interior space 12A of the room.

Preferably, the construction of the room 10 involves mounting vinyl material on the outside of 1" hollow box members 11. Over the vinyl material, metal strips 41A are placed to sandwich the vinyl material between a strip 41A and an associated frame member 11 via rivets 12B. This particular construction results in defining a plurality of wall panels 12 and door 23. It is to be understood that the three walls could be formed of either a single piece of vinyl or separate vinyl portions as desired in the circumstances. The location, spacing and number of rivets 12B is shown only representatively. In addition, the wall construction details are omitted in FIGS. 6 and 7 for ease of illustration.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what is desired to secure by Letters Patent of the United States is:

The invention claimed is:

1. A mobile clean room comprising a vertically disposed rectangular room frame having an upper and lower portion, a plurality of wall panels affixed between said upper and lower portion of said frame to define an interior space and to form an end wall and front and rear walls, a vertically elongated rectangular door hingedly affixed to said frame solely forming another end wall of said room, a floor panel affixed to said lower portion of said frame, a plurality of wheels affixed to said lower portion of said frame closely adjacent said floor panel for movably carrying said frame, a dust collection assembly movably attached to said upper portion of said frame and selectively positionable vertically against a ceiling, said wall panels and said door being formed of non-load bearing transparent plastic material to enable substantially unobstructed visibility through said room; said dust collection assembly including a horizontally disposed rectangular curtain frame carrying a coextensive rectangular ceiling seal and defining an access space and a subtending curtain affixed to said curtain frame, said curtain being located interiorly of and being connected to said room frame, said curtain frame being lowerable and raiseable vertically to fit closely adjacent a ceiling surface with said ceiling seal being compressed, only one pair of spaced hollow guides within said interior space attached to said upper portion of said room frame, only one pair of spaced posts subtending from said curtain frame and located to fit within a corresponding said guide and being movable vertically therein by a user from within said room, only one pair of spaced locking fasteners attached between said guide and respective said post to selectively secure each said post in a desired position with said ceiling seal compressed.

2. The room as defined in claim 1 wherein said wheels are lockable and swiveling.

3. The room as defined in claim 1 further including a ladder mounted to and slidable laterally between said side walls, said ladder being supported at its lower end by said floor panel.

4. The room as defined in claim 1 further including an electrical receptacle attached outwardly of and to said room frame for providing electrical power into said room from an external source of electric power.

5. The room as defined in claim 1 further including a vacuum apparatus in said interior space, said floor panel including an exhaust port therethrough for exhausting air from said interior space to beneath said floor panel, said vacuum apparatus having an outlet communicating with said exhaust port to collect debris in said apparatus and exhaust filtered air therefrom and out said exhaust port.

6. The room as defined in claim 1 further including a rectangular deck mounted to said frame closely adjacent to and below said rectangular curtain frame and extending between said side walls and said end wall and being supported by said frame forming said walls.

7. A mobile clean room comprising a vertically disposed rectangular room frame having an upper and a lower portion, a plurality of wall panels affixed between said upper and lower portions of said frame to define an interior space and to form an end wall and front and rear walls, a door hingedly mounted to said frame and alone forming another end wall oppositely disposed from said end wall, a floor panel affixed to said lower portion of said frame, a plurality of wheels affixed to said lower portion of said frame closely adjacent said floor panel for movably carrying said frame, a ladder disposed in said interior space located between said upper portion of said room frame and said floor panel, a vacuum apparatus in said interior space having an outlet, said floor panel includes an exhaust port therethrough for removing filtered air exiting said outlet while retaining debris within said room, and a dust collection assembly movably attached to said upper portion of said frame, said dust collection assembly including a horizontally disposed rectangular curtain frame defining an access space and a subtending curtain affixed to said curtain frame and to said room frame, said curtain being located interiorly of said room frame, said curtain frame including a compressible seal extending along the entire said curtain frame and above said curtain frame and adapted to fit closely and compressed adjacent a ceiling surface.

8. The room as defined in claim 7 wherein said wall panels are formed of transparent plastic material.

9. The room as defined in claim 7 wherein said ladder is slideably mounted to said upper portion of said frame between said front and rear walls.

10. The room as defined in claim 7 further including a deck affixed to said upper portion of said room frame spacedly remote from said floor panel and closely adjacent said rectangular curtain frame.

11. The room as defined in claim 7 further including an electrical female receptacle attached to said deck into which a user of said room may plug tools therein.

12. The room as defined in claim 11 further including an electrical male receptacle attached to said room frame for providing electrical power into said room to said female receptacle from an external source of electric power.

13. The room as defined in claim 7 wherein said wheels are swivelable for allowing rolling movement of said room in a plurality of directions and are lockable to inhibit movement of said room.

14. The room as defined in claim 7 further including a bracket attached to said upper portion of said room and another bracket attached to said ladder, said brackets forming grooves with one groove facing upwardly and another groove facing downwardly, said another groove being located in said another bracket and said one groove being located on said upper portion of said room and supporting said another groove therein for slideably mounting said ladder thereto.

15. The room as defined in claim 7 wherein said dust collection assembly includes a pair of spaced hollow guides attached to said upper portion of said room frame, a pair of spaced posts attached to said curtain frame respectively adjacent respective front and rear walls, said pair of posts respectively located within respective said guides and movable vertically therein by a user from within said room, a pair of locking fasteners attached between respective said guides and said posts therein to selectively secure each said post in its upper position with said ceiling seal compressed.

* * * * *